US008051983B2

(12) United States Patent
Simon et al.

(10) Patent No.: US 8,051,983 B2
(45) Date of Patent: Nov. 8, 2011

(54) PEELABLE, CHILD-RESISTANT PACKAGE FOR FILM-SHAPED DRUG FORMS

(75) Inventors: Michael Simon, Boppard-Buchholz (DE); Markus Krumme, Randolph, NJ (US); Karin Ludwig, Datzeroth (DE); Bodo Asmussen, Bendorf (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 11/664,083

(22) PCT Filed: Sep. 10, 2005

(86) PCT No.: PCT/EP2005/009746

§ 371 (c)(1),
(2), (4) Date: Apr. 14, 2008

(87) PCT Pub. No.: WO2006/037424

PCT Pub. Date: Apr. 13, 2006

(65) Prior Publication Data

US 2008/0190809 A1 Aug. 14, 2008

(30) Foreign Application Priority Data

Sep. 30, 2004 (DE) ..... 10 2004 047 447

(51) Int. Cl.
*B65D 83/04* (2006.01)
*B65D 85/42* (2006.01)

(52) U.S. Cl. ..... 206/532; 206/538; 206/484; 206/531

(58) Field of Classification Search ..... 206/469, 206/528–540, 467
See application file for complete search history.

(56) References Cited

U.S. PATENT DOCUMENTS

| | | | | | |
|---|---|---|---|---|---|
| 3,630,346 | A | * | 12/1971 | Burnside | 206/532 |
| 3,809,220 | A | * | 5/1974 | Arcudi | 206/484 |
| 3,835,995 | A | * | 9/1974 | Haines | 206/536 |
| 3,872,970 | A | | 3/1975 | Edison | |
| 3,921,805 | A | * | 11/1975 | Compere | 206/532 |
| 3,941,248 | A | | 3/1976 | Moser et al. | |
| 4,011,949 | A | | 3/1977 | Braber et al. | |

(Continued)

FOREIGN PATENT DOCUMENTS

CA 2281593 8/1999

(Continued)

*Primary Examiner* — Mickey Yu
*Assistant Examiner* — Chun Cheung
(74) *Attorney, Agent, or Firm* — D. Peter Hochberg; Sean F. Mellino; Daniel J. Smola

(57) ABSTRACT

A package for flat, pliable objects, such as for wafer-shaped or film-shaped drug forms. The package has a carrier layer, a cover layer which is detachably connected to the carrier layer, and a first surface region wherein the carrier layer is not connected to the cover layer and is completely surrounded by a margin area. A cavity, enclosed on all sides, is formed for accommodating an object. The package has a second surface region wherein the carrier layer is not connected to the cover layer. At least one perforation line extends at least partially within the second surface region, and is provided both in the carrier layer and in the cover layer.
Severing the perforation line forms a free edge of the cover layer which serves as a gripping aid and enables manual removal of the cover layer from the carrier layer. The disclosure further covers a process for packaging flat, pliable objects by forming the above-described package.

29 Claims, 6 Drawing Sheets

U.S. PATENT DOCUMENTS

| | | | | |
|---|---|---|---|---|
| 4,243,144 | A | 1/1981 | Margulies | |
| 5,046,618 | A * | 9/1991 | Wood | 206/532 |
| 5,325,968 | A * | 7/1994 | Sowden | 206/532 |
| 5,862,915 | A * | 1/1999 | Plezia et al. | 206/528 |
| 6,155,423 | A | 12/2000 | Katzner et al. | |
| 6,338,407 | B2 * | 1/2002 | Danville | 206/532 |
| 6,520,329 | B1 | 2/2003 | Fuchs et al. | |
| 7,011,843 | B2 | 3/2006 | Becher et al. | |
| 7,316,317 | B2 * | 1/2008 | Harper | 206/532 |
| 2006/0200098 | A1 | 9/2006 | von Falkenhausen | |

FOREIGN PATENT DOCUMENTS

| | | |
|---|---|---|
| DE | 2751078 | 5/1979 |
| DE | 1961359 | 10/1997 |
| DE | 197 06 825 | 9/1998 |
| DE | 19743485 | 4/1999 |
| DE | 19856845 | 6/2000 |
| DE | 10307583 | 9/2004 |

* cited by examiner

PEELABLE, CHILD-RESISTANT PACKAGE FOR FILM-SHAPED DRUG FORMS

CROSS-REFERENCE TO RELATED APPLICATIONS

This application is a National Stage application of International Application No. PCT/EP2005/009746, filed on Sep. 10, 2005, which claims priority of German application number 10 2004 047 447.8, filed on Sep. 30, 2004.

BACKGROUND OF THE INVENTION

1. Field of the Invention

The present invention relates to packages for flat, pliable objects, especially for film-shaped or wafer-shaped drug forms. These are non-reclosable packages the contents of which become accessible upon opening the package by peeling off a cover layer (e.g. peel film), and opening of which does not necessitate the use of auxiliary means, especially tools (scissors, knives etc.). The packages according to the invention possess features which prevent unauthorized opening, especially by children, or at least render unauthorised opening more difficult. The invention further relates to the use of such packages for packaging flat, pliable objects, as well as processes for packaging such objects by means of the said packages.

2. Description of the Prior Art

Apart from the known administration forms for medicaments, such as tablets, capsules etc., so-called "wafers" are also used for the administration of medicaments, especially for oral administration thereof. These are small, thin plates made of an active substance-containing film and whose thickness and dimensions are adapted to the amount of active substance to be released. A wafer is generally flexible, soft, of low weight, and tearable. The overall thickness of such a film-shaped medicament may be 5 μm to 5 mm, usually 50 μm to 1 mm. The shape of its surface may be round, oval, triangular or quadrangular, or polygonal, or it may be of any rounded shape. Suitable active substances are medicinal agents of all classes, for example analgesics, psychopharmacologic agents, or even nicotine for smoking cessation.

Because of the active substance content of the wafers, it is indispensable to package them in such a way that they cannot be removed and taken or swallowed by unauthorized persons, especially by children. At least, the process of opening the package should be made more difficult or delayed.

Child-resistant packages are known above all in the field of blister packages for tablets. For example, opening such a package can be made more difficult by providing the lid layer of the blister package with a peel layer which prevents the tablet from being pushed through the lid layer, and thereby prevents removal of the tablet. Only after having peeled off the peel layer is it possible to remove the tablet in the usual manner, by pushing it through the lid layer (DE 196 13 959 A1). Such packages are, however, not suitable for packaging thin, flexible drug forms (e.g. wafers) since, due to their physical characteristics, wafers cannot be removed from a package by pushing them through the package.

DE 197 43 485 A1 describes a child-resistant package for products that have a large area and are sensitive to pressure, e.g. transdermal therapeutic systems. The package is made of a dimensionally stable carrier sheet and a peelable, flexible cover layer; the two sheets are sealed to one another. The carrier sheet is provided with a perforation which can be broken open by bending. On breaking open the perforation, a broken edge is formed which serves as a gripping aid for peeling off the cover layer. Unauthorised opening by children is prevented by the fact that the rigidity of the sheets sealed to one another is such that children are not able to summon up the strength in their fingers which is required to bend open the break-open aid, while adults are able to do so.

A disadvantage of this package is that opening of the package is possible without hindrance once the first obstacle—bending open—has been overcome. The resultant gripping aid even facilitates peeling away the cover layer.

SUMMARY OF THE PRESENT INVENTION

The object of the invention was therefore to provide a package which is suitable for packaging flat, pliable objects, especially wafer-shaped ("wafers") or film-shaped drug forms, and which makes unauthorised opening and removal of the contents of the package more difficult or prevents the same, especially unauthorised opening and removal by children.

This object is achieved in accordance with the present invention by a package for flat, pliable objects, especially for wafer-shaped or film-shaped drug forms, wherein the package has a carrier layer and a cover layer detachably connected to the carrier layer, wherein

- the package has a first surface region wherein the carrier layer is not connected to the cover layer and which is completely surrounded by a margin area wherein the carrier layer is detachably connected to the cover layer, whereby a cavity, enclosed on all sides, is formed, for accommodating an object;
- the package has a second surface region wherein the carrier layer is not connected to the cover layer;
- at least one perforation line is present which extends at least partially within the second surface region, the perforation being provided both in the carrier layer and in the cover layer;
- severing the perforation results in the formation of a free edge of the cover layer which serves as a gripping aid and enables manual removal of the cover layer from the carrier layer.

Due to the above-indicated design features, the process of opening the package requires a combination and sequence of at least two actions which must be performed independently from one another in order to expose the drug form contained in the package.

First, the package has to be folded and severed along the perforation. Only by these folding and severing operations is the gripping aid made accessible, which in the subsequent step must be grasped with the fingers to enable the peeling away of the cover layer from the carrier layer, thereby making the drug form contained in the cavity accessible.

Since the perforation line is not only provided in the carrier layer but also in the cover layer, the cover layer is likewise severed when the carrier layer is being torn off along the perforation. This prevents the torn-off section of the carrier layer from being able to serve as a gripping aid for the cover layer. In order to proceed with the opening procedure, it is instead required to grasp the free edge, which has been formed by tearing the perforation, with ones fingers, as described above.

Prior to severing the perforation, the edge of the cover layer, which later serves as a gripping aid, is inaccessible and cannot be grasped with ones fingers as it is connected with the underlying carrier layer. Since, as described above, opening the package necessitates a combination and sequence of at least two actions, unauthorised opening of the package, especially by children, is made more difficult or is prevented. The necessity of performing a sequence of actions reduces the risk of children causing an opening of the package by playful action.

To produce the carrier layer and the cover layer, packaging materials of paper, cardboard, plastic films (e.g. polyethylene, polyethylene terephthalate, polypropylene, polystyrene, cellophane, polyamides, polycarbonates, ethylene-vinyl acetate copolymer) and metal foils (e.g. aluminium foil) as well as composite materials made of the aforementioned materials come into consideration. A further, preferred, film material is BAREX® (BP Chemicals)—a copolymer of acrylonitrile and butadiene. Due to its good barrier properties and chemical resistance it is especially suitable for packaging medicaments containing aggressive and/or volatile active substances, e.g. nicotine.

To exclude unauthorised or accidental destruction of the package by tearing apart, pointed objects, etc., it is necessary for each of the two packaging material components (carrier layer, cover layer) to have a high tear strength (e.g. according to DIN 53455 or EN-ISO 527). Materials suitable therefor are known to those skilled in the art. The thickness of the carrier layer and of the cover layer is preferably in the range from 0.01 to 2 mm, especially 0.05 to 0.5 mm. In a preferred embodiment of the invention, the carrier layer of the package is of a greater thickness than the cover layer.

The carrier layer and the cover layer may be produced from the same materials or from different materials. Preferably, at least one of the two packaging material components (carrier layer, cover layer) consists of a transparent material (e.g. transparent plastic film).

The invention further comprises embodiments wherein one packaging material component or both packaging material components are of the same or of a different colour, with each component possibly being of transparent or of an opaque colour.

For example, the carrier web may be produced from a non-transparent composite material of paper (or cardboard) with plastics (e.g. polyethylene-coated or polyethylene terephthalate-coated paper), and the cover layer may be produced from a transparent, colourless or coloured plastic film. To reduce the permeability to air, light and water vapour, it is advantageous if at least one surface of the carrier layer or/and of the cover layer is metallized (e.g. coated with aluminium).

According to a further embodiment it is preferred that both packaging material components have a similarly high flexural strength (determinable according to ASTM D 747 or DIN 53121) and tear strength.

As mentioned, the carrier layer and the cover layer may be similar or identical in terms of their composition (materials), properties (e.g. thickness, transparency) or/and their function. Therefore, opening of the package can also be performed in such a manner that after severing of the perforation a free edge of the carrier layer (instead of the cover layer) is used as a gripping aid in order to peel the carrier layer away from the cover layer. Generally, upon opening the package, both the free edge of the carrier layer and the free edge of the cover layer are jointly used as gripping aids to detach the two packaging material components from one another.

The carrier layer is detachably connected to the cover layer in such a way that the cover layer can be peeled off the carrier layer by using the strength of ones fingers and without the aid of tools, as is known from other peelable packages.

The term "peelable packaging" refers only to the manner in which the opening is performed (by detaching or peeling away the one half of the packaging material from the other half of the packaging material, as described above). The term does not limit the invention in terms of the usable packaging materials.

The inventive package may be produced in the most varied geometrical shapes (e.g. rectangle, square, triangle, trapezium, circle, and ellipse) and in various dimensions. The extent of the surface is generally dependent on the size of the product to be packaged (e.g. a wafer) and is usually in the range from 10 to 100 $cm^2$. Likewise, the size of the first surface region for accommodating the product to be packaged may be varied within a wide range, depending on the extent of the surface of the objects to be packaged.

The carrier web and the cover layer may be of identical shape and size; however, embodiments are also provided wherein the cover layer is of a smaller size than the carrier layer or/and has a geometric shape that diverges from that of the carrier layer.

The second surface region, wherein the two packaging material components are not connected with each other, serves to form a gripping aid for peeling away the cover layer once the perforation has been severed. The size of this second surface region may likewise be varied within a wide range. However, the surface region should at least be dimensioned large enough to enable secure gripping of the gripping aid. Therefore, its width (perpendicular to the direction of tearing open) is preferably at least 0.5 cm, especially at least 1 cm.

The detachable, peelable connection between the cover layer and the carrier layer is may be produced by sealing or welding; means and processes suitable for this purpose are known to those skilled in the art. Both heat-sealing processes and cold-sealing processes come into consideration. Materials which may be used for the sealing layers are, for example, hot-melt adhesives (hotmelts; e.g. on the basis of polyethylene-LD), seal lacquers, sealing dispersions, or adhesives. The peelable connection is preferably formed by heat sealing at temperatures in the range between 50° C. and 200° C., especially 50 to 90° C., using hotmelts.

According to a preferred embodiment, it is provided that the second surface region is likewise completely surrounded by a margin wherein the carrier layer is removably connected to the cover layer. The advantage thereof is that the gripping aid formed after severing of the perforation line is still connected with the carrier layer at the two sides, which additionally renders it more difficult to tear open the package. This results in the necessity of performing a further coordinated action in order to grasp the gripping aid.

As an alternative, according to a further embodiment of the invention, it is provided that the second surface region, on two opposing sides thereof, extends up to the respective outer edges of the package, and that in these regions the carrier layer is not connected to the cover layer. In this case, the gripping aid formed after severing the perforated line is, at its two lateral edges, not connected to the carrier layer.

The first surface region may be completely surrounded by a sealed seam or a sealed margin.

To achieve an effective protection against unauthorised tearing open, it is additionally preferred that the margin area enclosing the first surface region extends up to the outer margin of the package. Within this region, the cover layer is connected to the carrier layer over the entire surface thereof.

The invention also encompasses such embodiments wherein the first surface region, together with the sealed margin surrounding it, does not extend up to the outer margins of the carrier web, i.e. the area of the cover layer, in this case, is smaller than the area of the carrier web.

For reasons of manufacturing technology, the packages according to the invention may have a narrow outer margin wherein the two packaging material components are not connected to each other. This outer margin is, however, so small (maximally about 1 mm) that it cannot serve as a gripping aid and cannot be used for tearing open the package.

According to a further preferred embodiment, the inventive packages have a partition between the first surface region, forming the cavity for accommodating the object to be packaged, and the second surface region, whose region the carrier layer is detachably connected to the cover layer, preferably by sealing. By enlarging the size of the area of this partition, or its width relative to the direction of tearing open, the operation of tearing the package open can additionally be made more difficult.

As mentioned, the special features of the package according to the invention result in the fact that unauthorised opening of the package is prevented or at least rendered more difficult.

According to a preferred embodiment, the inventive package is a child-resistant, non-reclosable package meeting the requirements according to DIN EN 14375 or/and according to ASTM D3475-03a. According to DIN EN 14375, the term "child-resistant package" means a package which makes it more difficult for young children to open the package and to gain access to the contents of the package, but which enables-adults to use the package in an appropriate way.

The above-mentioned perforation lines may be produced in a known manner, e.g. by punching. Apart from such perforation lines, other types of weakened lines also come into consideration, provided that they enable tearing. The length and width of the individual perforations forming the perforation lines may be selected—depending on the tear strength and thickness of the carrier layer and cover layer—such that the strength of ones fingers necessary to sever the perforation can be easily summoned up by adult persons, but generally not by young children. By employing this measure it is possible to achieve an additional increase in child-resistance, if necessary.

In the packages according to the invention, there is at least one perforation line which runs at least partially within the second surface region. The expression "within the second surface region" also includes the case where a perforation line extends along an outer margin of this surface region.

The package is preferably designed such that the perforation line or, if two or more perforation lines are present, at least one of several perforation lines runs from a first outer edge of the package to a second outer edge of the package.

Furthermore, the perforation line or at least one of several perforation lines may be arranged such that it additionally extends through a margin area wherein the carrier layer is detachably connected to the cover layer.

According to a further preferred embodiment, it is provided that the package has a first perforation line which extends from a first outer edge of the package to a second outer edge of the package, and that it additionally has a second perforation line which is shorter than the first perforation line and which touches or intersects the latter, preferably at right angles. In this way, grasping of the gripping aid is facilitated.

The package according to the invention may be present as a single package, but it is also provided to combine two or more such packages so that one package unit results, e.g. in the form of a strip or a card. These packages, which are connected with one another, may be present in rolled-up form or folded in the manner of an accordion. Perforation lines may be provided between the individual, connected packages to enable separation of an individual package. For example, about 50 to 500 of such packages may be rolled up, in the form of a dispenser roll, around a winding core. Each of the packages, which are connected with and can be separated from one another, contains a single dose of a pharmaceutical active substance, and each one of these packages possesses the features of a child-resistant package, as described above.

Furthermore, two or more individual packages may also be connected with one another in a radial-symmetric arrangement, whereby a package unit in the form of a dispenser disc is formed, from which the individual packages can be separated one after the other. In this case, too, each of the packages, which are connected with and separable from one another, contains a single dose of an active substance, and each one of these packages possesses the features of a child-resistant package, as described hereinabove.

Preferably, the package units described hereinabove are used together with dispensing devices which are suitable for this purpose and which enable or facilitate separation and removal of the individual packages.

The invention further encompasses the use of the above-described packages for packaging flat, pliable objects, especially for the packaging of wafer-shaped or film-shaped drug forms, and especially preferably for the child-resistant packaging of medicaments.

The present invention further relates to a process for packaging flat, pliable objects, especially for packaging wafer-shaped or film-shaped drug forms. This process comprises the following steps:

- providing a carrier layer;
- positioning at least one object in a first surface region of the carrier layer;
- covering the carrier layer and the object located thereon with a cover layer;
- connecting the carrier layer and the cover layer by a detachable connection, in such a manner that the first surface region is completely surrounded by a margin area wherein the carrier layer is connected to the cover layer, and that the carrier layer is not connected to the cover layer within the first surface region, thereby forming a completely enclosed cavity containing the object, and that the package comprises a second surface region wherein the carrier layer is not connected to the cover layer;
- producing at least one perforation line which at least partially extends within the second surface region, the perforation being provided both in the carrier layer and in the cover layer.

BRIEF DESCRIPTION OF THE DRAWINGS

Further advantageous features and embodiments of the invention will be illustrated in the following by the examples of embodiments represented in the accompanying drawings. These drawings are merely schematic representations, showing.

DETAILED DESCRIPTION OF THE PRESENT INVENTION

Figure 1A:
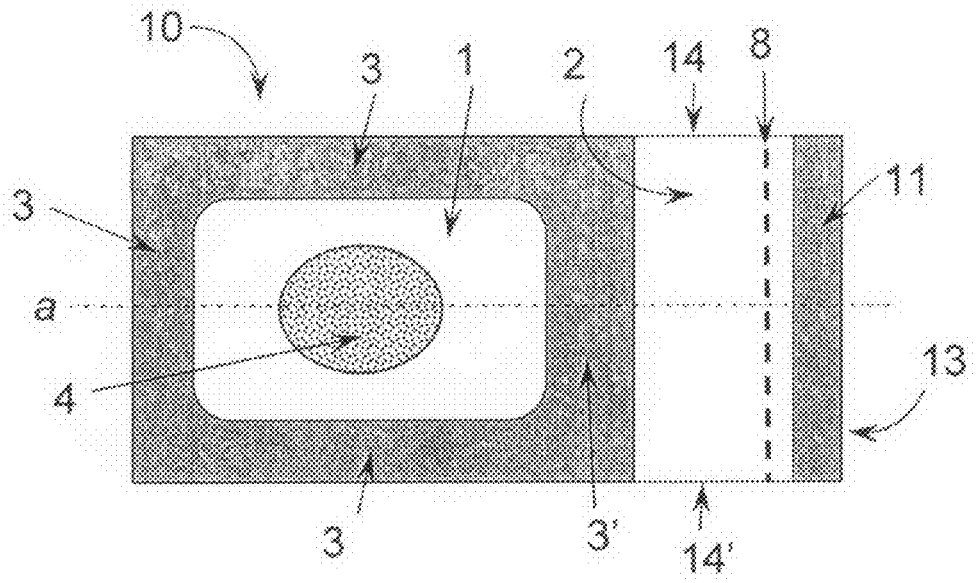
FIG. 1A is a top plan view of a package according to the present invention.

FIG. 1A shows a package (10) with a rectangular outline which comprises a first surface region (1) and a second surface region (2). The cover layer (7) (FIG. 1B) has the same geometric shape and size as the carrier layer (6) (FIG. 1B) and is connected thereto over its entire surface, with the exception of the first and the second surface regions (1, 2).

In the first surface region there is arranged an object or a packaged product (4). In the region of the grey-coloured areas, the cover film is detachably (i.e. peelably) connected to the carrier layer.

Notwithstanding the embodiment shown in FIG. 1A, the cover layer (7) may differ in its geometric shape and size from the carrier layer (6). In particular, the carrier layer (6) may have a larger area than the cover layer (7).

The first surface region (1) is completely surrounded by a margin (3, 3') wherein the cover film (7) is connected to the carrier layer (6). Between the first surface region (1) and the second surface region (2) there is a partition (3') where the cover film is connected to the carrier layer. Between the second surface region (2) and an outer edge (13) of the package there is a further surface region or margin area (11) where the cover film is connected to the carrier layer. This surface region (11) prevents the cover layer from being detached from the carrier layer (or vice versa) prior to severing of the perforation.

The second surface region (2) extends up to two opposing sides (14, 14'), up to the respective outer edges of the package, with the carrier layer (6) in these regions not being connected to the cover layer (7).

In the area of the second surface region (2) there is provided a perforation line (8) running from a first outer edge (14) of the package to a second outer edge (14') of the package.

Preferably, the second surface region (2) is limited on at least two sides by a sealed seam or sealed area, namely, on the one hand, by the partition (3) and, on the other hand, by the margin area (11), which extends up to the outer edge of the package.

Figure 1B:
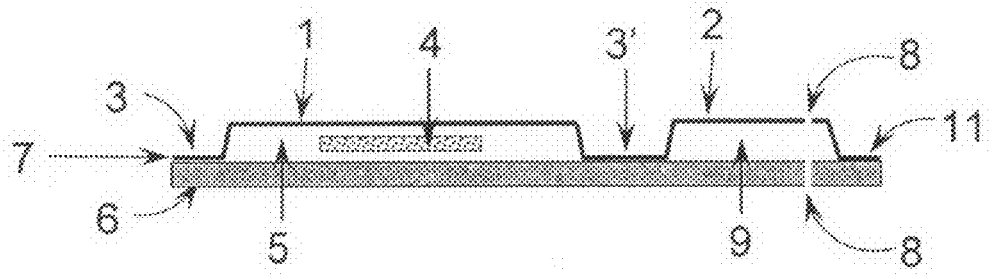
FIG. 1B is a longitudinal cross-section view through the package shown in FIG. 1A, along line (a)

FIG. 1B shows the design configuration of the package shown in FIG. 1A, comprising a carrier layer (6) and a cover layer (7) detachably connected thereto. These two packaging material components are detachably connected to one another in the regions (3), (3') and (11), e.g. by a peelable seal layer (not shown). Within the first surface region (1) there is formed a cavity (5) by the carrier layer (6) and the cover layer (7), for accommodating an object or a product (4) to be packaged. In a similar way, a cavity (9) is formed in the region of the second surface region (2). This cavity, however, is open to the outside as the perforation (8) is provided both in the carrier layer (6) and in the cover layer (7). The two perforation lines are arranged one upon the other so as to be congruent with one another.

Figure 1C:
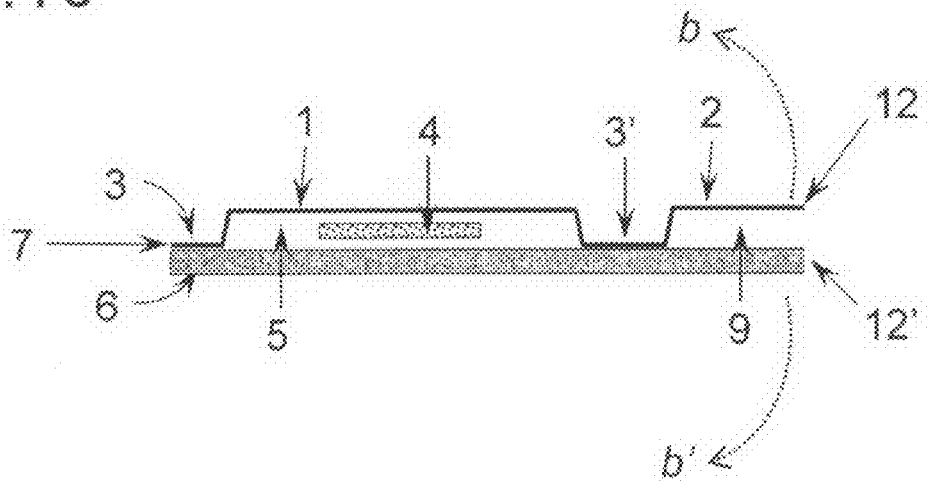
FIG. 1C is a longitudinal cross-section view as shown in FIG. 1B, with the package being present in the state after the perforation has been severed.

FIG. 1C shows the package (10) depicted in FIG. 1B, in the state after the perforation (8) has been completely severed. At the severed perforation line (8), a free edge (12) of the cover layer (7) and a free edge (12') of the carrier layer (6) has been formed. The free edge (12) and/or the free edge (12') can be used as a gripping aid for peeling away the cover layer from the carrier layer (approximately in the direction of the arrows b, b').

It should be appreciated that the representations in FIGS. 1B and 1C do not depict the actual proportions (this similarly applies also to all the other schematic representations). In particular, the height of the cavity (5) and (9) does not correspond to the actual height, which is substantially smaller.

Figure 1D:
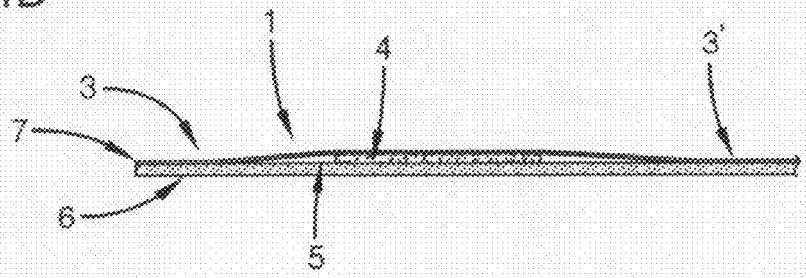
FIG. 1D is a part of the longitudinal cross-section view shown in FIG. 1C, in the region of the first surface region.

The representation in FIG. 1D is a closer approximation to the actual proportions than FIGS. 1B and 1C. In this way it can be noticed that the flat object (4), e.g. a wafer-shaped medicament, is jammed between the carrier layer (6) and the cover layer (7), which are connected to each other at their margins (3, 3').

Figure 2:
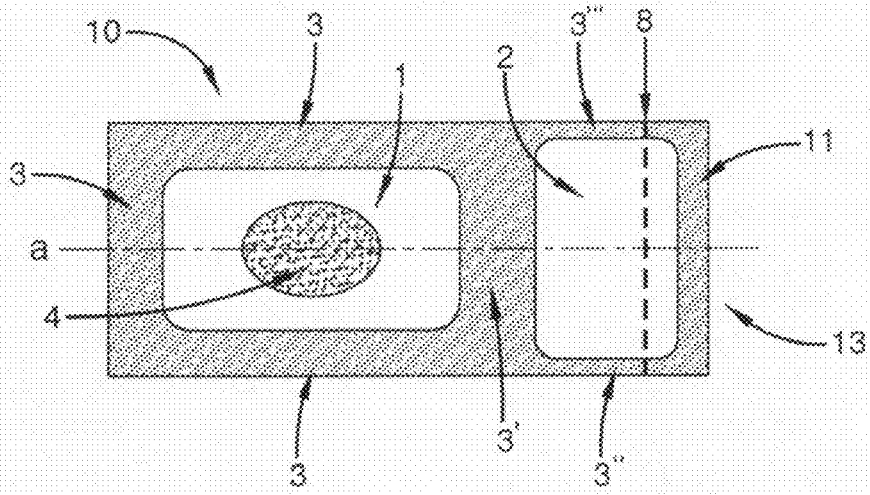
FIGS. 2 to 10 are top plan views of further embodiments of the package according to the present invention.

FIG. 2 shows a further embodiment of the package (10) shown in FIG. 1A. In this case, the second surface region (2) is completely surrounded by a margin (3', 3", 3''', 11) wherein the carrier layer (6) is detachably connected with the cover layer (7). The perforation line (8) extends within the surface region (2) and additionally through a margin area (3") wherein the carrier layer (6) is connected to the cover layer (7). It is advantageous here that after the perforation has been severed, the gripping aids (12, 12') remain connected to one another in these lateral areas, so that only the edges (12, 12') are freely accessible. This requires a further coordinated action in order to be able to grasp the gripping aids (12, 12').

Figure 3:
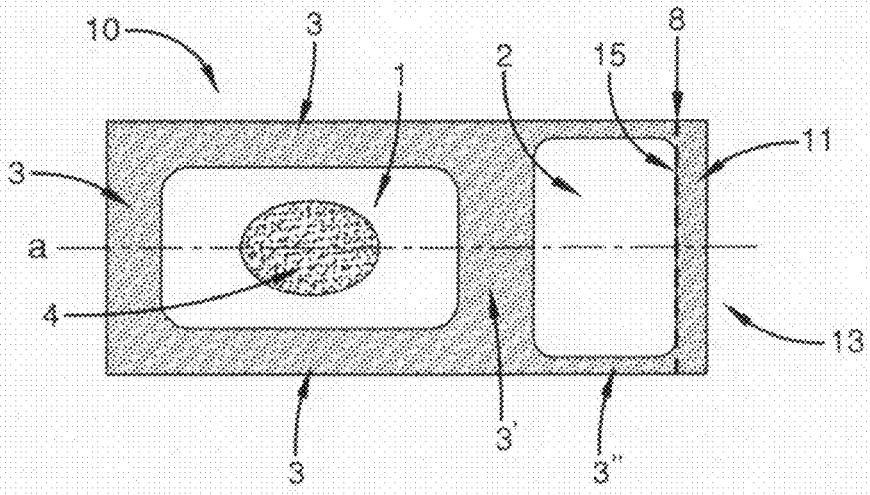

FIG. 3 shows a further embodiment of a package according to the invention wherein the perforation line (8) runs along an outer margin (15) of the second surface region (2). In this case, too, the two gripping aids (12, 12') become accessible after the perforation (8) has been severed.

Figure 4:
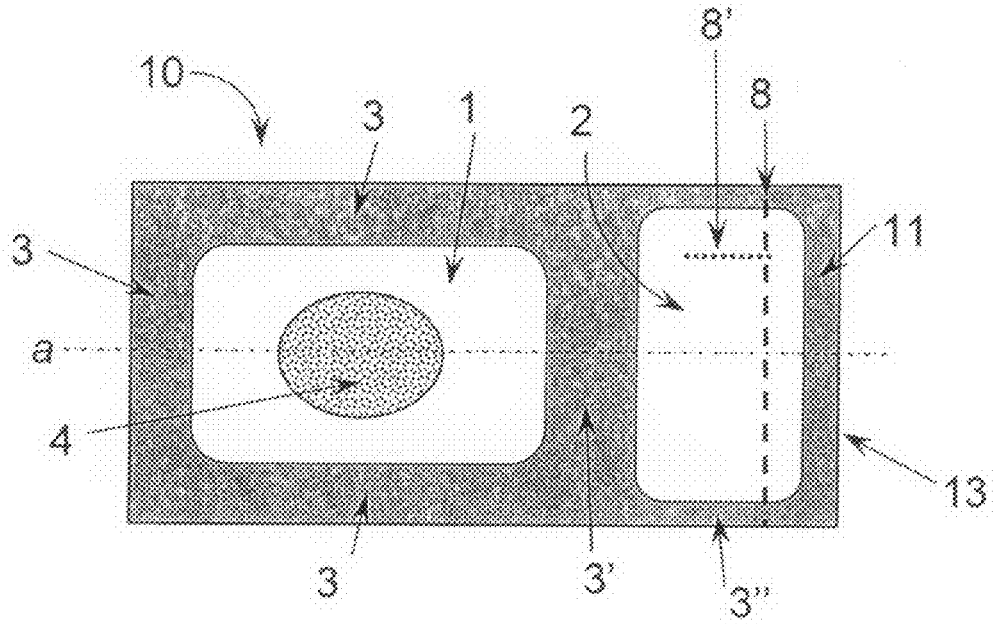

FIG. 4 shows a further embodiment of the package (10) shown in FIG. 1A, which has a first perforation line (8) running from a first outer edge of the package to a second outer edge of the package, and which additionally has a second perforation line (8') which is shorter than the first perforation line (8) and touches or intersects the latter (in the present case at right angles). After having been severed, this second perforation line facilitates gripping of the gripping aid (12 and/or 12'). The second perforation line 8' may be provided in both packaging material components, or only in the cover layer 7, or only in the carrier layer 6. The length and position of the auxiliary perforation (8') may vary.

Figure 5:
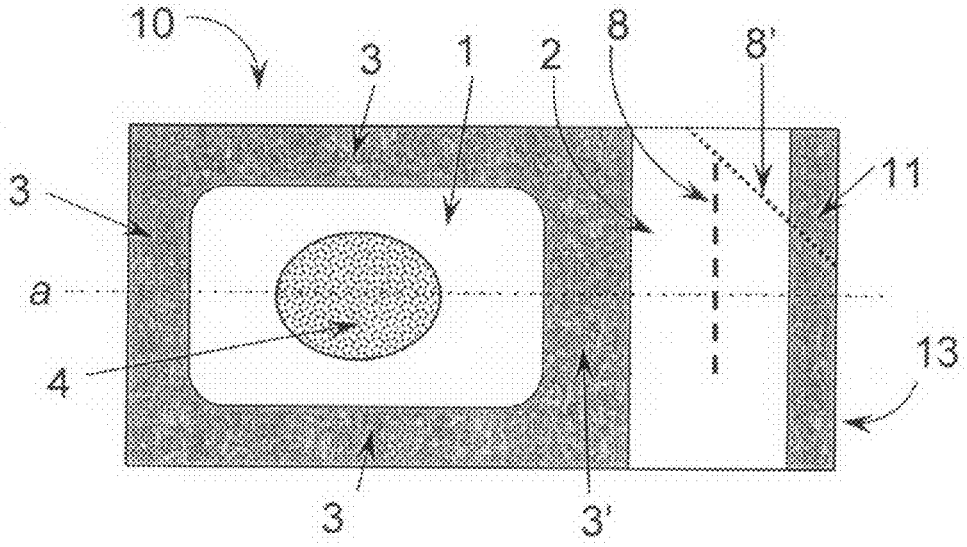

FIG. 5 shows a further embodiment of the package (10) shown in FIG. 1A, which has a first perforation line (8) running within the surface region (2), but not up to the outer edges of the package 10, and which additionally has a second perforation line (8') which touches or intersects the first perforation line (8) and extends up to the outer edges of the package 10. The second perforation line (8') preferably forms an acute angle with the first perforation line 8.

This measure ensures that the perforation line (8) which is positioned inwardly can only be severed if the perforation (8') has previously been severed. This additionally makes opening the package more difficult since two coordinated actions (severing the perforations 8 and 8') are necessary in order to expose the gripping aid.

Figure 6:
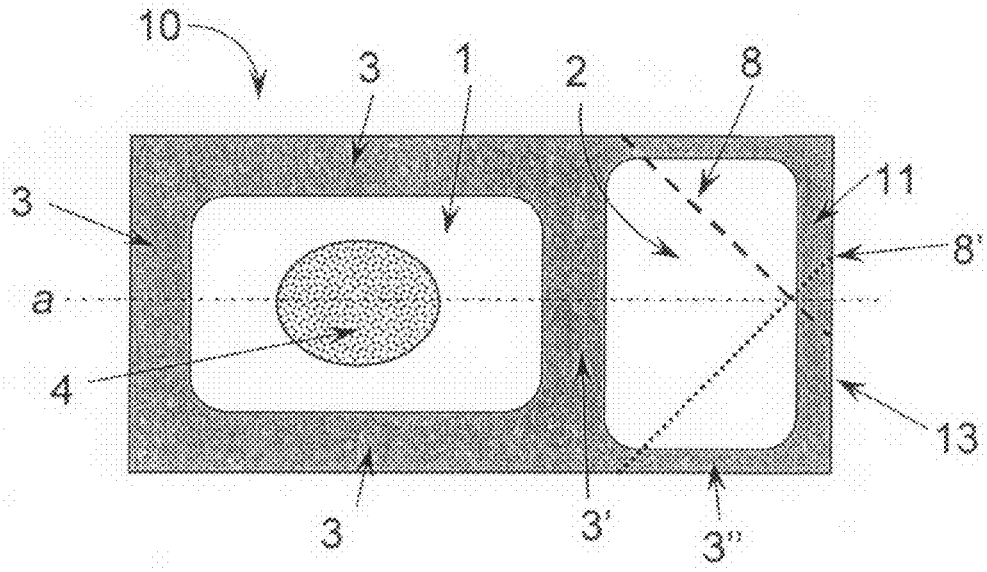

FIG. 6 shows a further embodiment of the package (10) shown in FIG. 1A, which has a first perforation line (8) and a second perforation line (8'), with both perforation lines extending within the surface region (2) and into the adjoining margin areas (3", 11) up to the outer edges of the package 10. Although severing of the two perforations (8, 8') results in a free edge of the carrier web 6 and of the cover layer 7, this edge, due to its small length, cannot be grasped with ones fingers. Only after both perforations (8, 8') have been severed, is there formed a gripping aid which can be grasped with one's fingers and can be used to strip the cover layer 7 from the carrier layer 6 (or vice versa). In this way a greater protective effect against unauthorised opening of the package by young children is achieved.

Figure 7:
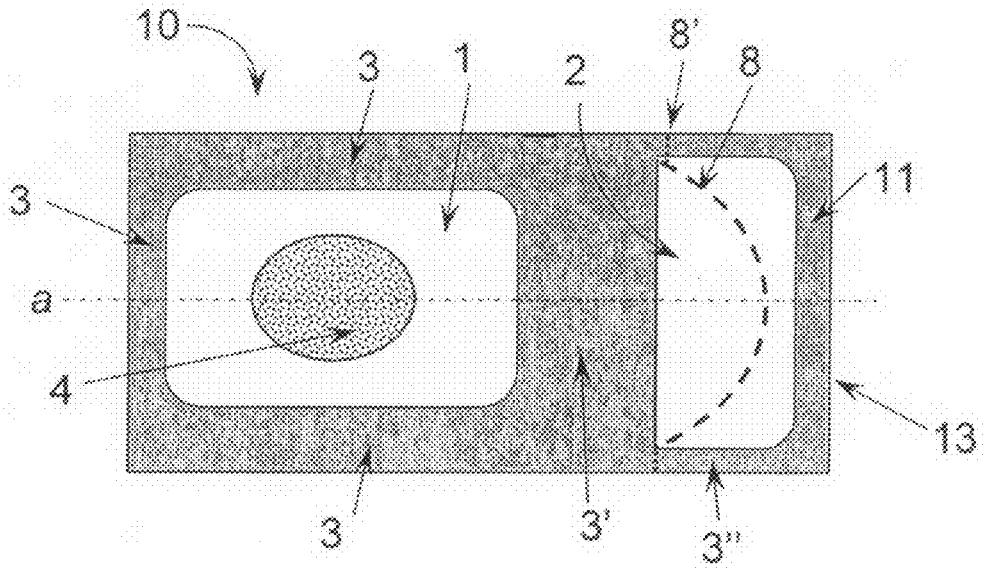

FIG. 7 shows yet another embodiment of an inventive package (10), wherein the second surface region (2) is bound by a rounded perforation line (8). In addition, there is provided an auxiliary perforation (8') running from an outer edge of the package to the rounded perforation (8). After severing of the perforations, gripping aids (12, 12'; FIG. 1C) are obtained which have a convexly rounded outline.

Unlike in FIG. 7, the perforation line (8) may also have an irregular or asymmetric curve progression, or it may be combined with a further auxiliary perforation.

Figure 8:
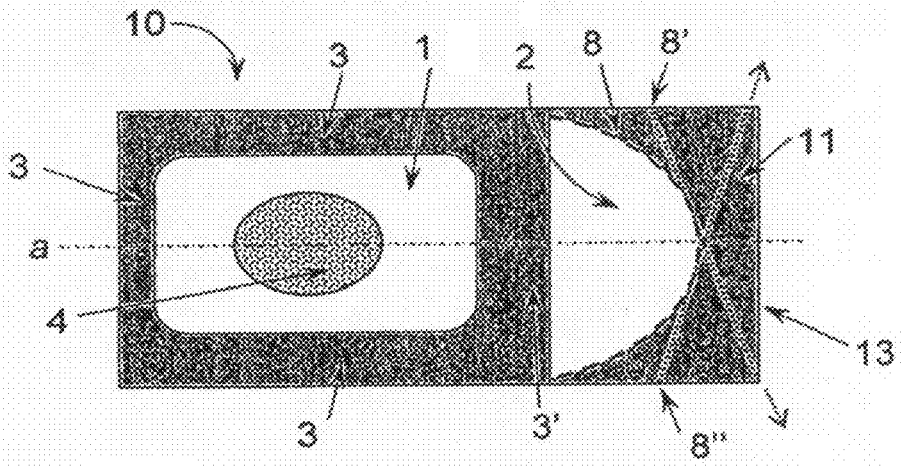

FIG. 8 shows a modification of the embodiment represented in FIG. 7, wherein two additional perforation lines (8', 8") are provided which extend tangentially to the rounded perforation (8). To open the package 10, the perforations (8', 8") are severed in the direction of the arrows. The perforations (8', 8") may run from one outer edge to another outer edge of the package 10, as shown. As an alternative, these perforations, or at least one of them, may only extend up to the intersection point with the perforation (8).

Figure 9A:
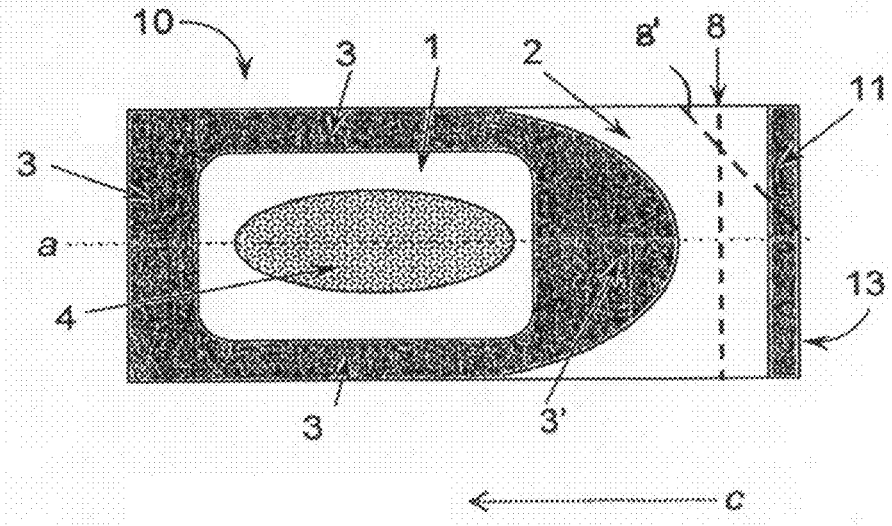
Figure 9B:
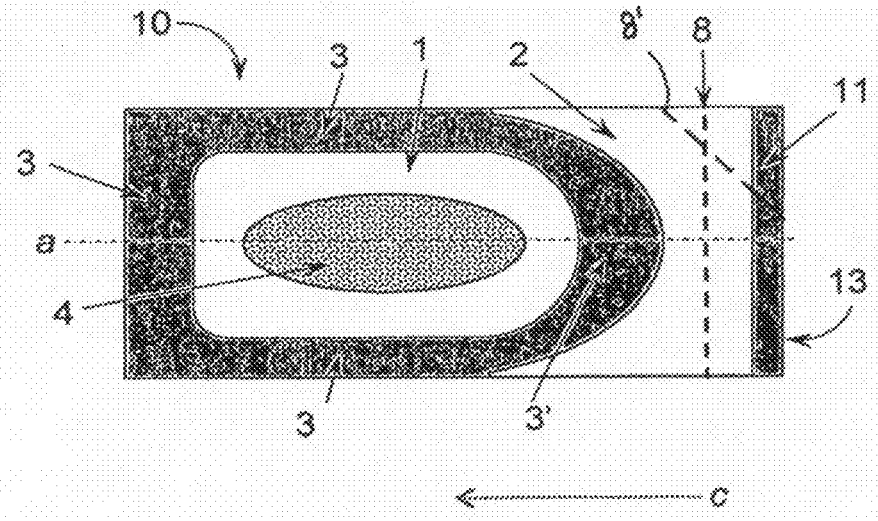

FIG. 9A shows a package 10 according to the invention, having a particularly advantageous configuration of the region of the partition (3') which in the present case is convexly rounded and projects into the second surface region (2) and which has a first perforation line (8) running from a first outer edge of the package to a second outer edge of the package, and which additionally has a second perforation line (8') which is shorter than the first perforation line (8) and touches or intersects the latter (in the present case at an acute angle). The configuration regarding the perforation lines (8, 8') is also shown in FIG. 9B. This facilitates tearing the package 10 open, i.e. detaching the two package material components (6, 7), after the perforation has been severed and the two gripping aids have been gripped. Since the width of the partition (3'), relative to the direction of tearing (arrow c), is initially small and then gradually increases, it is possible to tear the package open applying a lesser force, relative to those embodiments wherein the partition is of a constant width.

Since the partition (3') convexly projects into the second surface region (2), the first surface region (1) can be correspondingly extended towards the partition or may be convex (FIG. 9B). The length of the package (along line (a)) can thereby be reduced, or the extent of the first surface region (1) can thereby be enlarged, whereby an enlarged space (5) for accommodating the object to be packaged is created.

Unlike shown in FIG. 9, the region of the partition (3') may have the shape of a triangle or of a trapezium whose tip or shorter edge projects into the second surface region (2), similarly to the convexly rounded partition region shown in FIG. 9. Furthermore, the convex surface, or the triangle or trapezium, may be adapted so as to be asymmetric relative to the axis (a).

Figure 10:
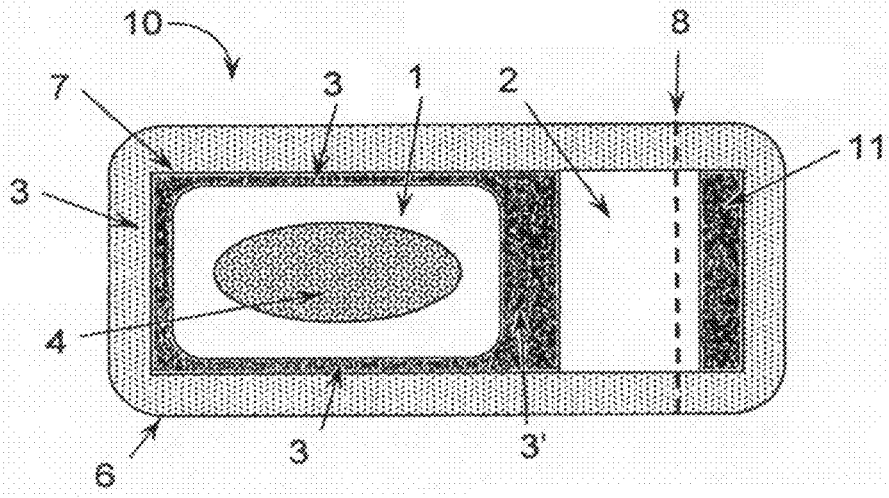

FIG. 10 shows an embodiment of the package according to the invention, wherein the carrier web (6) has a larger surface and a geometric shape different from that of the cover layer (7). In the region of the grey surfaces, the cover layer (7) is detachably (i.e. peelably) connected with the carrier web (6).

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

The invention claimed is:

1. A package for flat, pliable objects, especially for wafer-shaped or film-shaped drug forms, said package having a carrier layer and a cover layer having a free edge, said cover layer being detachably connected to said carrier layer, wherein the package is a single package or comprises two or more individual packages connected to one another, wherein said single package or each individual package of the two or more packages comprises:

a first surface region, a first margin area, a second margin area, a third margin area, a fourth margin area and a cavity, wherein the carrier layer is not connected to the cover layer at said first surface region, said first surface region being completely surrounded by said first margin area wherein the carrier layer is detachably connected to the cover layer, and wherein said cavity is enclosed on all sides and is formed for accommodating an object;

a second surface region within which the carrier layer is not connected to the cover layer and within which said cover layer and said carrier layer contiguously overlap each other, said second surface region being limited on one side by said first margin area, on another side by said second margin area which extends up to the outer edge of the package, opposite the first surface region, and within which the carrier layer is contiguously connected to the cover layer, said third margin area and said fourth margin area interconnecting said first margin area and said second margin area at two opposite ends of said second surface area, wherein said second surface region is completely surrounded by said first, second, third and fourth margin areas;

a first perforation line extending from a first outer edge of the package to a second outer edge of the package, and a second perforation line which is shorter than the first perforation line and touches or intersects the first perforation line at an acute angle, wherein each of said perforation lines extends at least partially within the second surface region; and a partition between the first surface region and the second surface region, wherein the carrier layer is detachably connected to the cover layer in the area of said partition, and wherein said partition extends into the second surface region in a configuration selected from the group consisting of convex curvature, the tip of a triangle and the short edge of a trapezium; wherein severing said first and second perforation lines forms said free edge of the cover layer, said free edge being a gripping aid for enabling manual removal of the cover layer from the carrier layer.

2. The package according to claim 1, wherein said cover layer is connected to the carrier layer by sealing.

3. The package according to claim 1, further comprising a margin completely surrounding said the second surface region, wherein the carrier layer is detachably connected to the cover layer.

4. The package according to claim 1, wherein said package is a child-resistant, non-reclosable package meeting the demands according to at least one of DIN EN 14375 and ASTM D3475-03a.

5. The package according to claim 1, further comprising a sealed seam or a sealed margin completely surrounding the first surface region.

6. The package according to claim 1, wherein said first margin area surrounding the first surface region extends up to the outer margin of the package.

7. The package according to claim 1, wherein said at least one perforation line runs from a first outer edge of the package to a second outer edge of the package.

8. The package according to claim 1, wherein said first perforation line additionally runs through said second margin area and said third margin area, or through said second margin area and said fourth margin area, or through said third margin area and said fourth margin area.

9. The package according to claim 1, wherein said first perforation line and said second perforation line both extend within said second surface region and into the adjoining second margin area and said third or fourth margin area.

10. The package according to claim 1, wherein said cover layer is of the same geometric shape and size as the carrier layer and is contiguously connected to said carrier layer, except at said first and the second surface regions.

11. The package according to claim 1, wherein said cover layer differs from the carrier layer in terms of at least one of size and geometric shape.

12. The package according to claim 1, wherein said package is a component of a package unit containing two or more packages which are connected to and are separable from one another.

13. Use of a package according to claim 1, for packaging flat, pliable objects, especially for packaging wafer-shaped or film-shaped drug forms.

14. The use according to claim 13, wherein said package is used for the child-resistant packaging of medicaments.

15. A process for packaging flat, pliable objects, especially for packaging wafer-shaped or film-shaped drug forms, said process comprising the following steps:

providing a carrier layer having a first surface region;

positioning at least one object in said first surface region of the carrier layer;

covering the carrier layer and the object located in said first surface region with a cover layer;

connecting the carrier layer and the cover layer by a detachable connection, in such a manner that the first surface region is completely surrounded by a first margin area in which the carrier layer is connected to the cover layer, and the carrier layer is not connected to the cover layer within the first surface region, for forming a completely enclosed cavity containing the object, and wherein the package has a second surface region wherein the carrier layer is not connected to the cover layer;

contiguously connecting the carrier layer and the cover layer within a second margin area to limit said second surface region by said first margin area and said second margin area which extends up to the outer edge of the package, opposite the first surface region, and further contiguously connecting the carrier layer and the cover layer within a third margin area and a fourth margin area interconnecting said first margin area and said second margin area, wherein said second surface region is completely surrounded by said first, second, third and fourth margin areas; and producing a first perforation line extending from a first outer edge of the package to a second outer edge of the package, and a second perforation line which is shorter than the first perforation line and touches or intersects the first perforation line at an acute angle, wherein each of said perforation lines extends at least partially within the second surface region.

16. The process according to claim 15, further comprising a sealing step for producing the detachable connection between the carrier layer and the cover layer.

17. The package according to claim 1, wherein said package comprises an axis of symmetry running midway through said first and second surface regions, and wherein said convex curvature, said tip of a triangle or said short edge of a trapezium is arranged as being symmetrical to said axis of symmetry running midway through said first and second surface regions.

18. The package according to claim 1, wherein said configuration is a convex curvature.

19. A package for flat, pliable objects, especially for wafer-shaped or film-shaped drug forms, said package having a carrier layer and a cover layer having a free edge, said cover layer being detachably connected to said carrier layer, wherein the package is a single package or comprises two or more individual packages connected to one another, wherein said single package or each individual package of the two or more packages comprises:

a first surface region, a first margin area, a second margin area, a third margin area, a fourth margin area and a cavity, wherein the carrier layer is not connected to the cover layer at said first surface region, said first surface region being completely surrounded by said first margin area wherein the carrier layer is detachably connected to the cover layer, and wherein said cavity is enclosed on all sides and is formed for accommodating an object;

a second surface region within which the carrier layer is not connected to the cover layer and within which said cover layer and said carrier layer contiguously overlap each other, said second surface region being limited on one side by said first margin area, on another side by said second margin area which extends up to the outer edge of the package, opposite the first surface region, and within which the carrier layer is contiguously connected to the cover layer, said third margin area and said fourth margin area interconnecting said first margin area and said second margin area at two opposite ends of said second surface area, wherein said second surface region is completely surrounded by said first, second, third and fourth margin areas;

a first perforation line extending from a first outer edge of the package to a second outer edge of the package, and a second perforation line which is shorter than the first perforation line and touches or intersects the first perforation line at an acute angle, wherein each of said perforation lines extends at least partially within said second surface region; and a partition between the first surface region and the second surface region, wherein the carrier layer is detachably connected to the cover layer in the area of said partition; wherein severing said first and second perforation lines forms said free edge of the cover layer, said free edge being a gripping aid for enabling manual removal of the cover layer from the carrier layer.

20. A package for flat, pliable objects, especially for wafer-shaped or film-shaped drug forms, said package having a carrier layer and a cover layer having a free edge, said cover layer being detachably connected to said carrier layer, wherein the package is a single package or comprises two or more individual packages connected to one another, wherein said single package or each individual package of the two or more packages comprises:

a first surface region, a first margin area, a second margin area, a third margin area and a cavity, wherein the carrier layer is not connected to the cover layer at said first surface region, said first surface region being completely surrounded by said first margin area wherein the carrier layer is detachably connected to the cover layer, and wherein said cavity is enclosed on all sides and is formed for accommodating an object;

a second surface region within which the carrier layer is not connected to the cover layer and within which said cover layer and said carrier layer contiguously overlap each other, said second surface region being limited on one side by said first margin area, on another side by said second margin area which extends up to the outer edge of the package, opposite the first surface region, and within which the carrier layer is contiguously connected to the cover layer, said third margin area interconnecting said first margin area and said second margin area at one end of said second surface area;

a first perforation line extending from a first outer edge of the package to a second outer edge of the package, and a second perforation line which is shorter than the first perforation line and touches or intersects the first perforation line at an acute angle, said second perforation line being located entirely within said second surface region; and a partition between the first surface region and the second surface region, wherein the carrier layer is detachably connected to the cover layer in the area of said partition; wherein severing said first and second perforation lines forms said free edge of the cover layer, said free edge being a gripping aid for enabling manual removal of the cover layer from the carrier layer.

21. A package for flat, pliable objects, especially for wafer-shaped or film-shaped drug forms, said package having a carrier layer and a cover layer having a free edge, said cover layer being detachably connected to said carrier layer, wherein the package is a single package or comprises two or more individual packages connected to one another, wherein said single package or each individual package of the two or more packages comprises:

a first surface region, a first margin area, a second margin area, a third margin area, a fourth margin area and a cavity, wherein the carrier layer is not connected to the cover layer at said first surface region, said first surface region being completely surrounded by said first margin area wherein the carrier layer is detachably connected to the cover layer, and wherein said cavity is enclosed on all sides and is formed for accommodating an object;

a second surface region within which the carrier layer is not connected to the cover layer and within which said cover layer and said carrier layer contiguously overlap each other, said second surface region being limited on one side by said first margin area, on another side by said second margin area which extends up to the outer edge of the package, opposite the first surface region, and within which the carrier layer is contiguously connected to the cover layer, said third margin area and said fourth margin area interconnecting said first margin area and said second margin area at two opposite ends of said second surface area, wherein said second surface region is completely surrounded by said first, second, third and fourth margin areas;

a first perforation line extending from a first outer edge of the package to a second outer edge of the package, and a second perforation line which is shorter than the first perforation line and touches or intersects the first perforation line at an acute angle, wherein said second perforation line is located entirely within said second surface region; and a partition between the first surface region and the second surface region, wherein the carrier layer is detachably connected to the cover layer in the area of said partition, and wherein said partition extends into the second surface region in a configuration selected from the group consisting of a convex curvature, the tip of a triangle and the short edge of a trapezium; wherein severing said first and second perforation lines forms said free edge of the cover layer, said free edge being a gripping aid for enabling manual removal of the cover layer from the carrier layer.

22. A package for flat, pliable objects, especially for wafer-shaped or film-shaped drug forms, said package having a carrier layer and a cover layer having a free edge, said cover layer being detachably connected to said carrier layer, wherein the package is a single package or comprises two or more individual packages connected to one another, wherein said single package or each individual package of the two or more packages comprises:

a first surface region, a first margin area, a second margin area, and a cavity, wherein the carrier layer is not connected to the cover layer at said first surface region, said first surface region being completely surrounded by said first margin area wherein the carrier layer is detachably connected to the cover layer, and wherein said cavity is enclosed on all sides and is formed for accommodating an object;

a second surface region within which the carrier layer is not connected to the cover layer and within which said cover layer and said carrier layer contiguously overlap each other, said second surface region being limited on one side by said first margin area, on another side by said second margin area which extends up to the outer edge of the package, opposite the first surface region, and within which the carrier layer is contiguously connected to the cover layer, and wherein said second surface region further has two opposing sides which extend up to the respective outer edges of the package, and said carrier layer is not connected to the cover layer in the regions where said two opposing sides of said second surface region extend up to the respective outer edges of the package;

a first perforation line extending from a first outer edge of the package to a second outer edge of the package, and a second perforation line which is shorter than the first perforation line and touches or intersects the first perforation line, wherein said second each of said perforation lines extends at least partially within the second surface region; and a partition between the first surface region and the second surface region, wherein the carrier layer is detachably connected to the cover layer in the area of said partition; wherein severing said first and second perforation lines forms said free edge of the cover layer, said free edge being a gripping aid for enabling manual removal of the cover layer from the carrier layer.

23. The package according to claim 22, wherein said second perforation line touches or intersects the first perforation line at an acute angle.

24. The package according to claim 22, wherein said second perforation line is located entirely within said second surface region.

25. The package according to claim 22, wherein said second perforation line touches or intersects the first perforation line at an acute angle and is located entirely within said second surface region.

26. The package according to claim 22, wherein said first perforation line extends within said second surface region and into the adjoining second margin area.

27. The package according to claim 22, wherein at least one of said perforations runs from a first outer edge of the package to a second outer edge of the package.

28. A package for flat, pliable objects, especially for wafer-shaped or film-shaped drug forms, said package having a carrier layer and a cover layer having a free edge, said cover layer being detachably connected to said carrier layer, wherein the package is a single package or comprises two or more individual packages connected to one another, wherein said single package or each individual package of the two or more packages comprises:

a first surface region, a first margin area, a second margin area, a third margin area, a fourth margin area, and a cavity, wherein the carrier layer is not connected to the cover layer at said first surface region, said first surface region being completely surrounded by said first margin area wherein the carrier layer is detachably connected to the cover layer, and wherein said cavity is enclosed on all sides and is formed for accommodating an object;

a second surface region within which the carrier layer is not connected to the cover layer and within which said cover layer and said carrier layer contiguously overlap each other, said second surface region being limited on one side by said first margin area, on another side by said second margin area which extends up to the outer edge of the package, opposite the first surface region, and within which the carrier layer is contiguously connected to the cover layer, said third margin area and said fourth margin area interconnecting said first margin area and said second margin area at two opposite ends of said second surface area, wherein said second surface region is completely surrounded by said first, second, third and fourth margin areas;

a first perforation line extending from a first outer edge of the package to a second outer edge of the package, and a second perforation line which is shorter than the first perforation line and touches or intersects the first perforation line, wherein at least one of said perforation lines extends at least partially within the second surface region; and partition between the first surface region and the second surface region, wherein the carrier layer is detachably connected to the cover layer in the area of said partition, and wherein said partition extends into the second surface region in a configuration selected from the group consisting of a convex curvature, the tip of a triangle and the short edge of a trapezium; wherein severing said first and second perforation lines forms said free edge of the cover layer, said free edge being a gripping aid for enabling manual removal of the cover layer from the carrier layer.

29. A package for flat, pliable objects, especially for wafer-shaped or film-shaped drug forms, said package having a carrier layer and a cover layer having a free edge, said cover layer being detachably connected to said carrier layer, wherein the package is a single package or comprises two or more individual packages connected to one another, wherein said single package or each individual package of the two or more packages comprises:

a first surface region, a first margin area, a second margin area, a third margin area and a cavity, wherein the carrier layer is not connected to the cover layer at said first surface region, said first surface region being completely surrounded by said first margin area wherein the carrier layer is detachably connected to the cover layer, and wherein said cavity is enclosed on all sides and is formed for accommodating an object;

a second surface region within which the carrier layer is not connected to the cover layer and within which said cover layer and said carrier layer contiguously overlap each other, said second surface region being limited on one side by said first margin area, on another side by said second margin area which extends up to the outer edge of the package, opposite the first surface region, and within which the carrier layer is contiguously connected to the cover layer, said third margin area interconnecting said first margin area and said second margin area at one end of said second surface area;

a first perforation line extending from a first outer edge of the package to a second outer edge of the package, and a second perforation line which is shorter than the first perforation line and touches or intersects the first perforation line at an acute angle, wherein said second perforation line is located entirely within said second surface region; and a partition between the first surface region and the second surface region, wherein the carrier layer is detachably connected to the cover layer in the area of said partition, and wherein said partition extends into the second surface region in a configuration selected from the group consisting of convex curvature, the tip of a triangle and the short edge of a trapezium; wherein severing said first and second perforation lines forms said free edge of the cover layer, said free edge being a gripping aid for enabling manual removal of the cover layer from the carrier layer.

* * * * *